United States Patent [19]

Ray, Jr.

[11] 3,984,839

[45] Oct. 5, 1976

[54] LOW HEIGHT VLF ANTENNA SYSTEM

[75] Inventor: Homer A. Ray, Jr., Dallas, Tex.

[73] Assignee: The United States of America as represented by the Secretary of the Air Force, Washington, D.C.

[22] Filed: May 15, 1975

[21] Appl. No.: 577,972

[52] U.S. Cl. ..... 343/749; 343/844; 343/846; 343/891

[51] Int. Cl.[2] ..... H01Q 9/18; H01Q 21/06

[58] Field of Search ..... 343/845, 846, 874, 749, 343/844, 891

[56] References Cited

UNITED STATES PATENTS

| | | | |
|---|---|---|---|
| 1,360,167 | 11/1920 | Alexanderson | 343/845 |
| 2,048,726 | 7/1936 | Bohm | 343/845 |
| 3,386,098 | 5/1968 | Mullaney | 343/845 |

*Primary Examiner*—Eli Lieberman

*Attorney, Agent, or Firm*—Joseph E. Rusz; Julian L. Siegel

[57] ABSTRACT

A low height, high efficiency antenna system in which a plurality of radiating elements are spaced to induce mutual radiation resistance in each other and the elements radiate using constant current which is obtained with a parallel folded element that receives the current prior to the radiating element, and since the current is moving in opposite directions in the folded element all but the constant current component is cancelled. The edge of the supporting tower can be used as one or two legs of the folded element.

4 Claims, 7 Drawing Figures

11
Ra
L
C
Rg

13
A1
15

17
A2
19

LOW HEIGHT VLF ANTENNA SYSTEM

STATEMENT OF GOVERNMENT INTEREST

The invention described herein may be manufactured and used by or for the Government for governmental purposes without the payment of any royalty thereon.

BACKGROUND OF THE INVENTION

This invention relates to low frequency antennas, and more particularly to a low frequency antenna system offering low height and very high efficiency.

There are significant advantages in radio communications in transmitting with low frequency signals. Low frequency signals offer a high degree of propagation stability and are also relatively immune to jamming. In addition, they are useful for communications at considerable depths under the sea or ground due to the deep penetration of ground currents. However, since low frequency signals have large wavelengths, larger antennas generally are needed. Therefore, there is a need in the art for low height antennas for propagation of low frequency signals. The present invention offers such a low height antenna together with a very high radiation resistance thereby offering a high efficiency.

SUMMARY OF THE INVENTION

The present invention is a low height antenna in terms of wavelength having improved bandwidth and efficiency and is particularly useful for low frequency down to 27 KHz and has a height of only 100 feet which is equivalent to one electrical degree. By combining a plurality of monopole radiating elements in array, the radiation resistance is increased without increasing the ground resistance thereby increasing the efficiency. The efficiency is also increased by using radiated elements that have constant current.

It is therefore an object of this invention to provide an antenna for broadcasting very low frequency, as low as 27 KHz, and at the same time having a low height relative to the wavelength.

It is another object to provide an antenna that has low height and an improved bandwidth.

It is still another object to provide an antenna system for transmission of VLF signals that offer a considerable increase in efficiency.

These and other objects, features and advantages of the invention will become more apparent from the following description taken in conjunction with the illustrative embodiments in the accompanying drawings.

DETAILED DESCRIPTION OF THE PREFERRED EMBODIMENT

Figures 1, 2A, 2B:
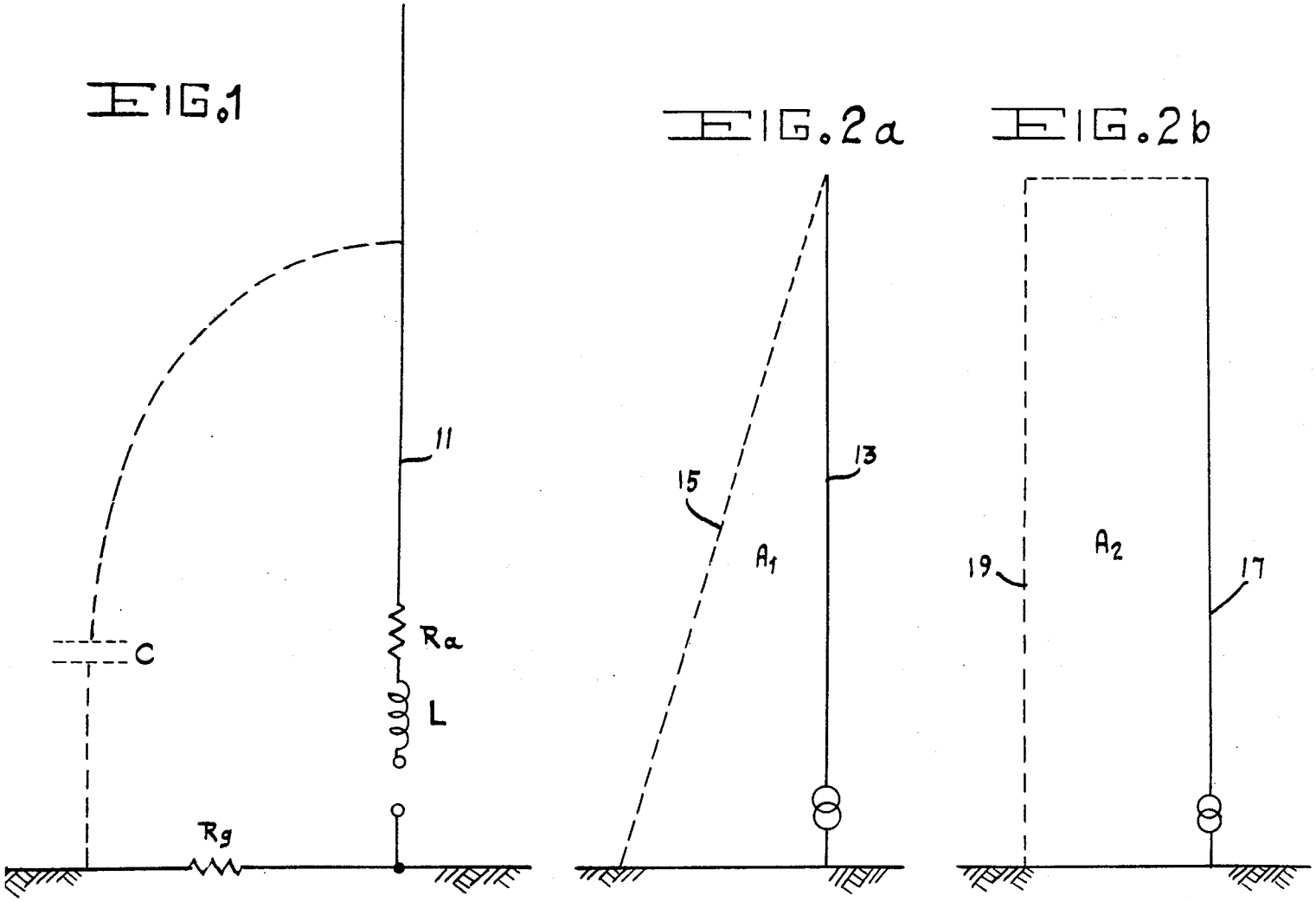
FIG. 1 is a diagram useful in the explanation of the invention of a typical short monopole antenna showing the lumped constants.
FIGS. 2*a* and 2*b* are diagrams showing a first method of increasing the radiation resistance relative to the ground resistance in a single monopole.

Referring to FIG. 1 which shows short monopole antenna 11 displayed as an equivalent circuit and showing the lumped constants, it can be seen that the equivalent circuit is a simple series resonant circuit having an inductance L and capacitance C and a radiation resistance Ra. Assuming that inductance L and capacitance C are lossless, the efficiency of the antenna is the ratio of radiation resistance Ra to the ground loss resistance Rg and this invention utilizes two systems for increasing the radiation resistance while the ground loss resistance remains constant thereby increasing the efficiency.

In explanation of the first system of increasing the radiation resistance, it is known that the radiation resistance of a simple monopole is proportional to the square of the area under the height curve (see LaPort, "Radio Antenna Engineering", McGraw Hill, N.Y. 1952). If the monopole is not top loaded the distribution is approximately linear with height for very short antennas as is shown in FIG. 2 where $A_1$ is the area under the curve formed by the height of antenna 13 and the distribution line 15. It can be seen that there is maximum current near the base of antenna 13 and linearly decreases to zero at the top. The radiation resistance for antenna 13 is $KA_1^2$ where K is the proportionality constant. If the monopole is top loaded to quarter wave resonance as shown in FIG. 2*b*, the current distribution is approximately constant over the vertical portion, where the area $A_2$ is bounded by the height of antenna 17 and line 19 representing the current distribution. The radiation resistance is then equal to $KA_2^2$. Since the area under the curve of the constant current monopole of FIG. 2*b* is twice that of the monopole of FIG. 2*a* with linearly changing current, it can be seen that the constant current element has a radiation resistance four times greater than the linear one.

Figure 3:
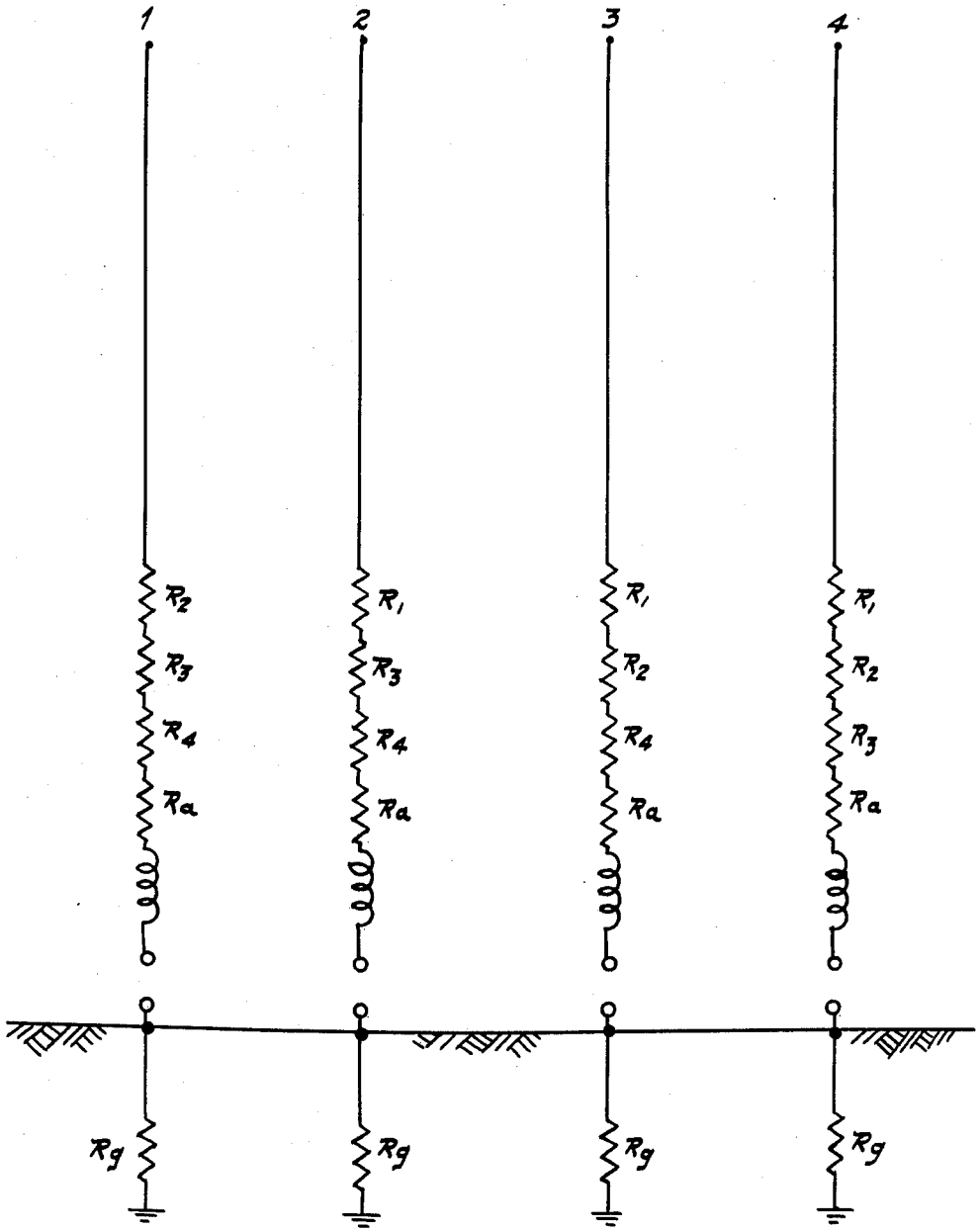
FIG. 3 is a diagram showing a second method of increasing the radiation resistance relative to the ground resistance of a plurality of monopoles.

Referring to FIG. 3 for the second system of increasing the radiation resistance, it is well known that a group of monopoles within one radian of each other and having equal-in-phase currents, insert a mutual radiation resistance in the circuit of each other monopole almost equal to the self radiation resistance. This makes the total radiation resistance of each monopole approximately equal to its self radiation resistance multiplied by the number of monopoles. In FIG. 4, the increase is about four times the self radiation resistance taken above because four antennas are shown. It can be seen that each antenna acquires the radiation resistance of the other three where $R_1$, $R_2$, $R_3$ and $R_4$ represent the radiation resistance acquired from antennas 1, 2, 3 and 4, respectively. The ground loss resistance remains the same.

Combining the effects of the two systems above, it is shown that each of the four monopoles with constant current have almost sixteen times the radiation resistance of one linear current monopole. If, as in the case of very short antennas, the radiation resistances are much smaller than the ground loss resistances, the efficiency is almost sixteen times higher by the two above disclosed methods for a four-element monopole antenna when using four monopoles.

Figure 4B:
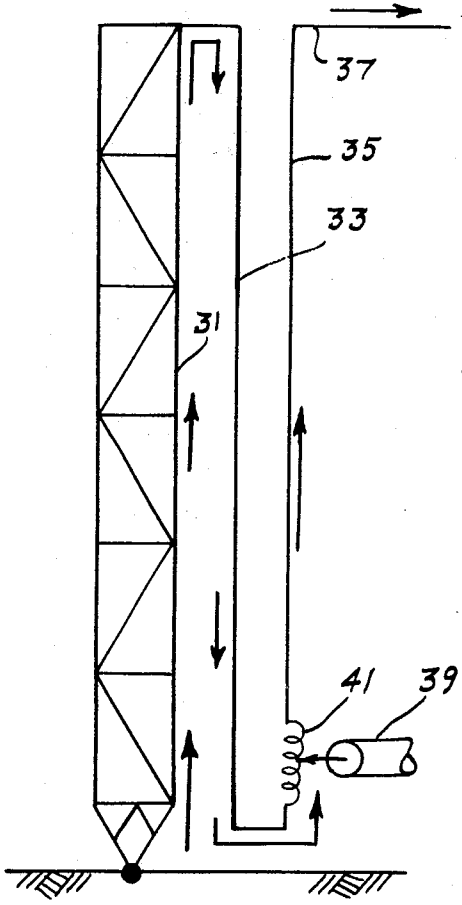
FIGS. 4*a* and 4*b* are diagrams showing two methods of obtaining constant current in a radiating monopole.
Figure 4A:
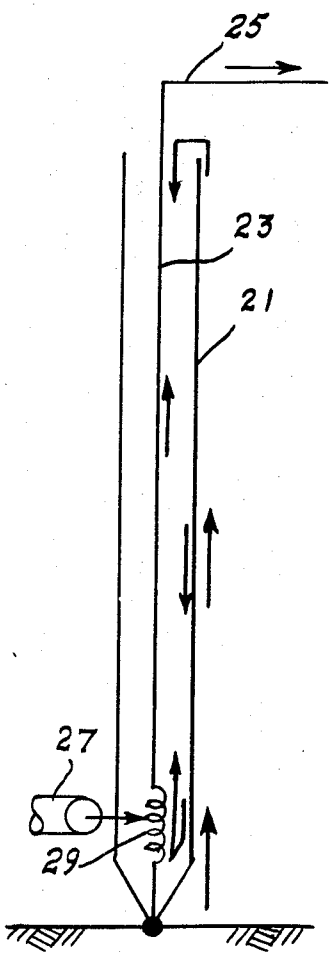

The system for achieving constant current on the radiating tower or element is shown in FIGS. 4*a* and 4*b*. The electrical path length includes the coil for the sine wave distribution for the current is one-quarter wavelength and the system is resonant at the operating frequency. In FIG. 4*a* the instantaneous current as shown by the arrows travels up and down the side of supporting structure or tower 21 which essentially acts as a cylinder. The tower could be a grid having openings which are small compared to the wavelength. The instantaneous current also has a direction up monopole element 23 to top loaded portion 25. Since the current moves in opposite directions on tower 21 it is canceled out leaving only the current on element 23 for radiation which is constant in amplitude over the element for a given increment of time. Both tower element 21 and monopole element 23 are connected to earth ground. The input generator 27 can be applied to coil 29 for a particular impedance (as for example, 50 ohms) by movement of the variable tap which can be slidably mounted upon coil 29.

In FIG. 4*b*, the side of tower 31 and adjacent parallel element 33 are used to cancel the current shown by the arrows and permit constant current on radiating monopole element 35. Top loading element 37 is added and the signal from input generator 39 is fed into adjustable tap of coil 41.

Figure 5:
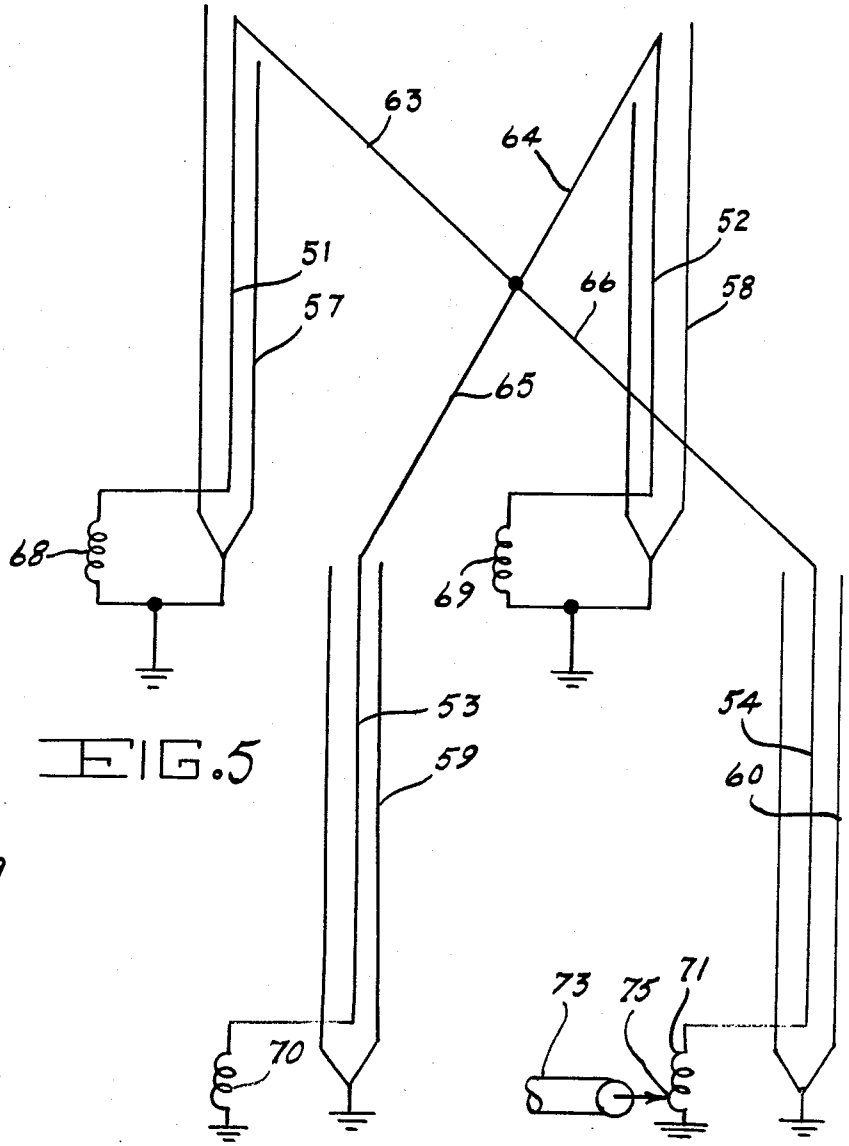
FIG. 5 is a diagram showing an embodiment of the invention.

An embodiment of the invention is shown in FIG. 5 which uses the features previously explained, i.e., a constant current radiating monopole with top loading and then a plurality of these monopoles for increasing radiation resistance. Radiating elements 51–54 having constant current are surrounded by towers or cylinders 57–60. Top loading elements 63–66 are in a crossconfiguration. Coils 68–71 are attached to elements 51–54 and are then grounded. These are for purposes top load and are then effectively at the top associated with elements 63–66. One of the coils 71 serves as a feedpoint for input 73 using its adjustable tap.

In another embodiment, the system for obtaining constant current shown in FIG. 4*b* could be used in the configuration of FIG. 5 (instead of the system shown in FIG. 4*a*) with similar results.

What is claimed is:

1. A monopole antenna system comprising:

a. a plurality of vertical radiating elements connected to ground;

b. a plurality of inductors, one each interposed between each vertical radiating element and ground;

c. means for interconnecting the plurality of vertical radiating elements;

d. means for feeding one of the inductors; and e. means for controlling a constant current in each of the radiating elements, including a plurality of supporting structures for one each of the plurality of vertical radiating elements, the supporting structures being grounded and having the longitudinal axes thereof parallel to the radiating elements whereby opposite currents are induced in the supporting structures for cancelling said currents therein.

2. A monopole antenna system comprising:

a. a plurality of vertical radiating elements;

b. a plurality of inductors, one each connected to each vertical radiating element;

c. means for interconnecting the plurality of vertical radiating elements;

d. means for feeding one of the inductors; and e. means for controlling a constant current in each of the radiating elements, including

1. a plurality of grounded supporting structures for one each of the plurality of vertical radiating elements; and

2. a plurality of conductors each having the longitudinal axes thereof parallel to one each of the plurality of supporting structures with one terminal connected to the top of the supporting structures and the other terminal connected to the inductors thereby cancelling currents in the supporting structures and the conductors.

3. A monopole antenna system according to claim 1 wherein the plurality of vertical radiating elements are spaced to be within one electrical radian of each other.

4. A monopole antenna system according to claim 3 wherein the feeding means comprises a variable tap slidably mounted on one of the inductors.

* * * * *